US005081722A

United States Patent [19]

Yu

[11] Patent Number: 5,081,722

[45] Date of Patent: Jan. 21, 1992

[54] ADJUSTABLE CRIB WITH VIBRATOR, MOISTURE SENSOR, FAN, MICROPHONE AND SPEAKER

[76] Inventor: Yuan-Chieh Yu, No. 5, Lane 20, Dah Der Rd., 7 Duu Dist., Ji-Long City, Taiwan

[21] Appl. No.: 668,898

[22] Filed: Mar. 13, 1991

[51] Int. Cl.[5] ..... A47D 7/03; A47D 9/02

[52] U.S. Cl. ..... 5/99.1; 5/109; 5/423; 5/508; 5/93.1

[58] Field of Search ..... 5/93.1, 94, 99.1, 102, 5/66, 67, 68, 108, 109, 423, 508

[56] References Cited

U.S. PATENT DOCUMENTS

| | | | |
|---|---|---|---|
| 2,646,576 | 7/1953 | Abrams | 5/99.1 |
| 2,646,735 | 7/1953 | ZumBrunnen | 5/431 |
| 2,866,454 | 12/1958 | McKenzie | 128/132 |
| 3,066,981 | 12/1962 | Welsh | 5/66 |
| 3,311,934 | 4/1967 | Goldberg | 5/102 |
| 3,545,016 | 12/1970 | Schorken | 4/572 |
| 4,066,072 | 1/1978 | Cummins | 128/40 |
| 4,484,573 | 11/1984 | Yoo | 128/138 A |
| 4,516,282 | 5/1985 | Topalian et al. | 5/66 |
| 5,003,651 | 4/1991 | Rosen | 5/109 |

*Primary Examiner*—Alexander Grosz

*Attorney, Agent, or Firm*—Morton J. Rosenberg; David I. Klein

[57] ABSTRACT

A baby crib comprising two symmetrical side frames and two grilles transversely connected between said two symmetrical side frames at two opposite ends. The bed floor members each have an axle at one end and positioning bolts at the opposite end for positioning bed floor members into circular recesses and positioning holes according to the desired angle of inclination. Sound detectors and humidity sensors are provided to detect discomfort situations and thus trigger alarms and/or comforting devices.

2 Claims, 4 Drawing Sheets

ADJUSTABLE CRIB WITH VIBRATOR, MOISTURE SENSOR, FAN, MICROPHONE AND SPEAKER

BACKGROUND OF THE INVENTION

1. Field of the Invention

The present invention relates to a baby crib, and more particularly relates to a baby crib that includes detectors to detect urine or other moisture, such as perspiration. Microphones are provided to detect noise, such as crying, with suitable mechanisms to trigger alarms and/or means to comfort the child.

2. Description of Prior Art

Prior art systems include a variety of baby cribs which provide specialized functions. As a prior art example, automatic vibratory mechanis have been attached to the frame of a baby crib to cause vibration of the crib to comfort the child therein.

SUMMARY OF THE INVENTION

It is the object of the present invention to provide a baby crib which can be conveniently set up or collapsed with means to respond to situations of discomfort providing motion or sound to help relieve these discomforts.

DESCRIPTION OF THE PREFERRED EMBODIMENT

Figure 1:
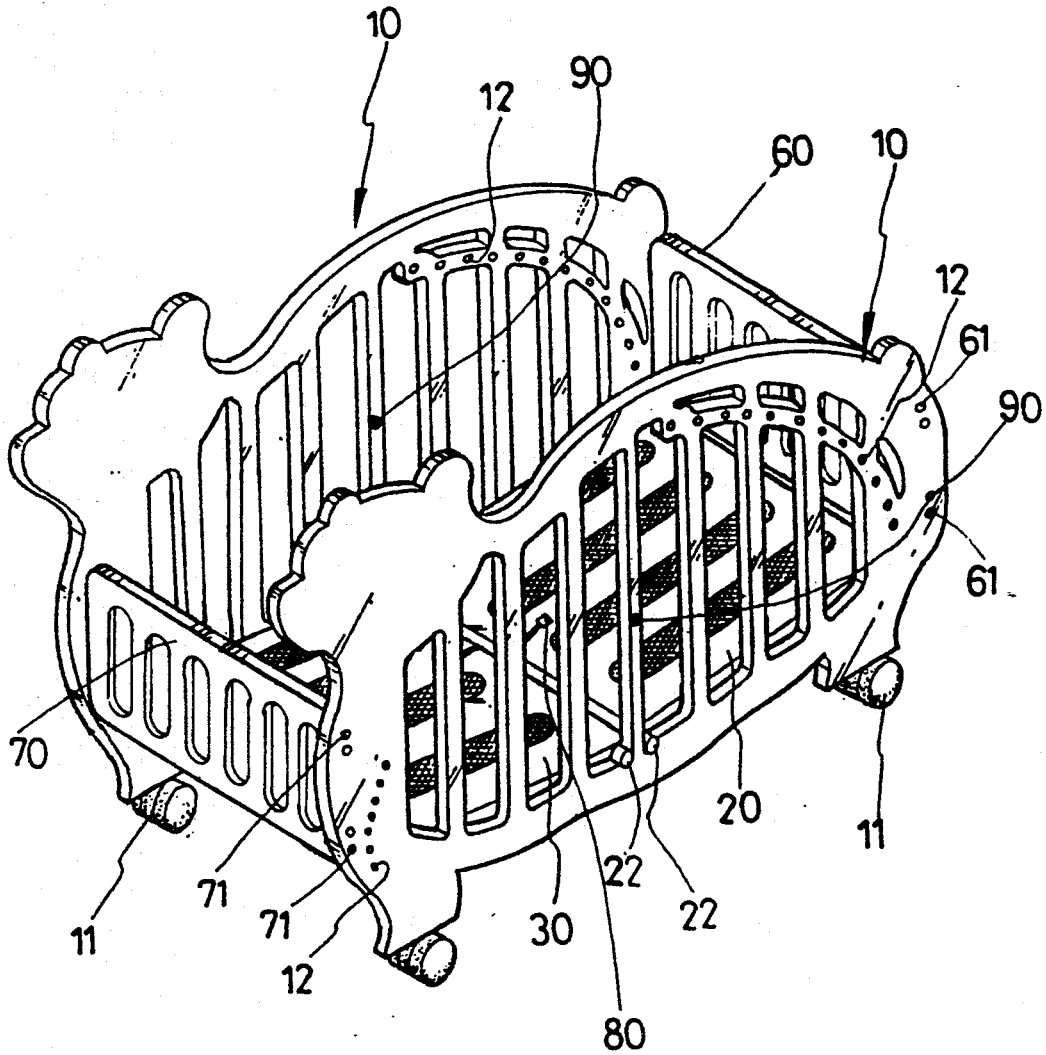
FIG. 1 is a perspective view of a baby crib of the present invention.
Figure 2:
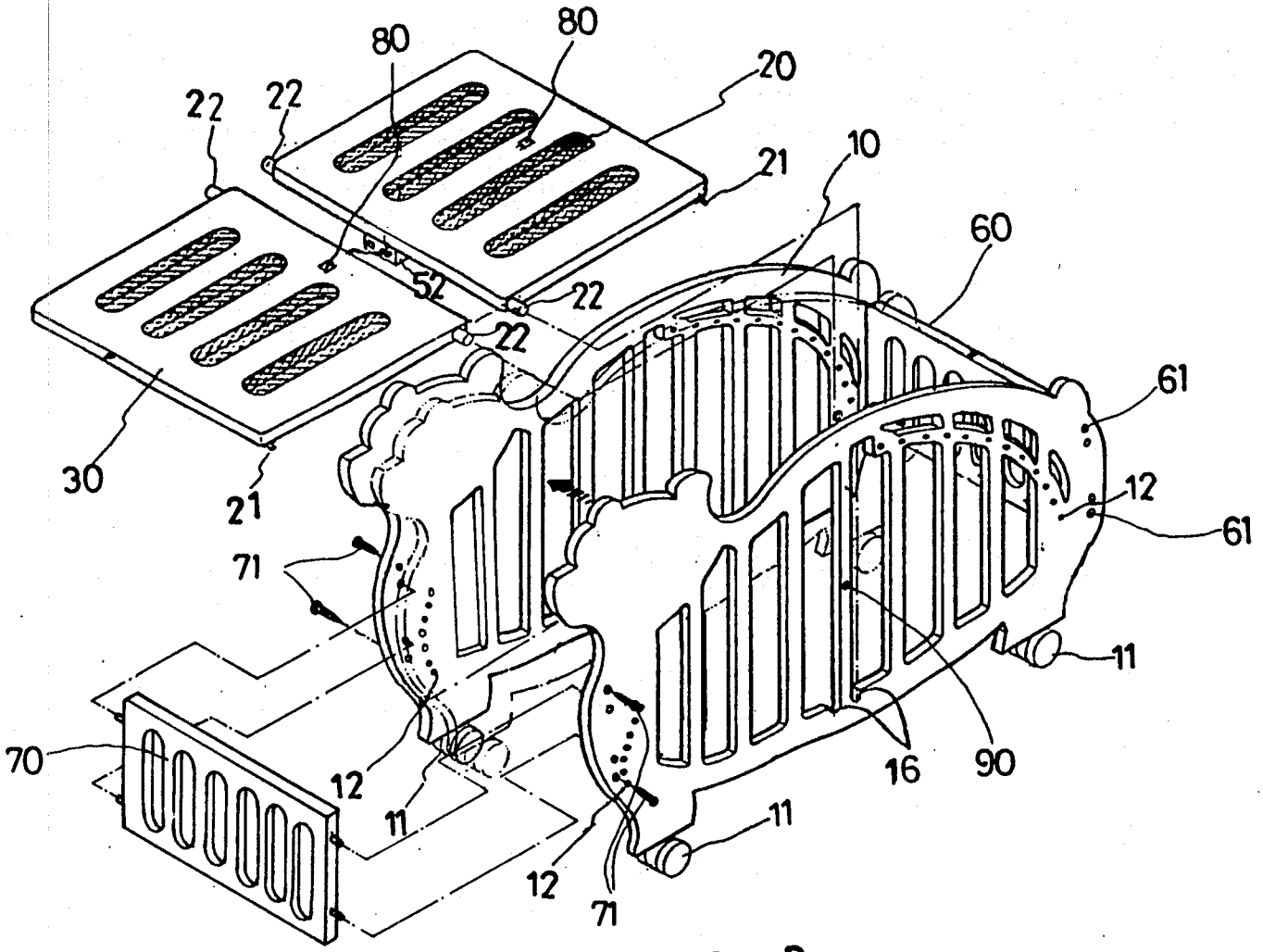
FIG. 2 is a perspective dismantled view thereof.
Figure 3:
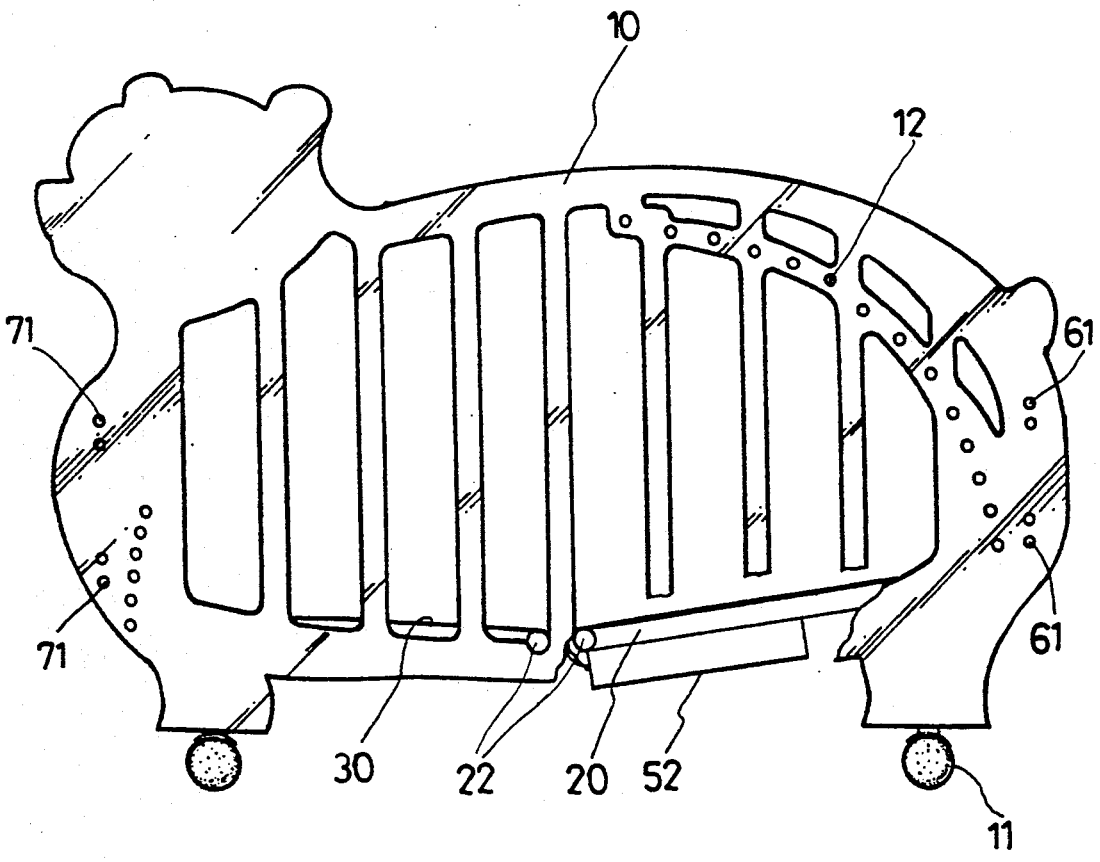
FIG. 3 is a side view thereof.

Referring to FIGS. 1 and 2, a baby crib in accordance with the present invention is shown which includes two symmetrical side frames 10 having located at opposite ends two grilles 60 and 70, which are coupled to the side frames 10 at the two opposite ends thereof by screws 71 and 61. Rollers 11 are respectively connected to the bottom of the side frames 10 at opposing corners. Two opposed bed floor members 20 and 30 are respectively mounted within crib cavity formed by side frames 10 and grilles 60, 70 utilizing axles 22 and bolts 21 bi-laterally projecting therefrom at opposite ends thereof. The two opposite ends of the axles 22 are respectively engaged in circular recesses 16 on each side of frame 10. The two opposite ends of bolts 21 are alternatively fastened in a pair of locating holes on each side of frame 10. By means of choosing pairs of locating holes 12, the floor members 20 or 30 can be adjusted to a desired angle of inclination.

Figure 4:
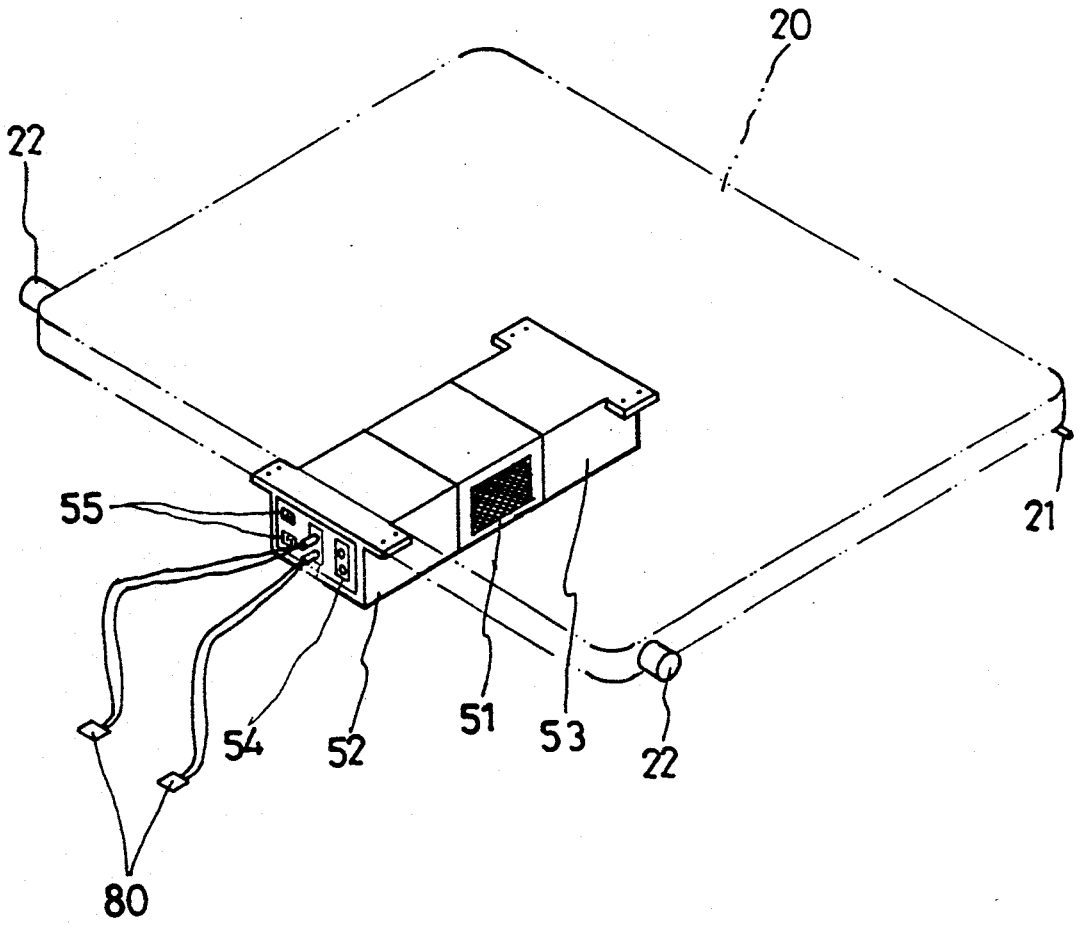
FIG. 4 is a bottom view of the bed floor member showing the location of the control box with air fan, micro-vibrator, the sound-control socket, and the control sockets.

Referring to FIG. 4, there is provided a control box 52, an air fan 51, and a micro-vibrator 53, respectively mounted on the bottom of the bed floor member 20. The control box 52 has control sockets 55 for connecting external audio equipment and sound-control socket 54 for connecting microphones 90 or humidity sensors 80. When the child cries, microphone 90 activates micro-vibrator 53 and external audio equipment to provide motion and sound to comfort the child. When the child passes urine or perspires, the humidity sensor 80 signals the air fan 51 for activation to provide flow of comforting air.

I claim:

1. A baby crib comprising:

a pair of longitudinally extending side frames;

a pair of grille members extending transversely on opposing longitudinal ends of said side frames and fixedly secured to said side frames, said side frames and said grille members forming an internal crib cavity;

a pair of bed floor members rotatably mounted to said side frames, each of said floor members having an axle member mounted on one end thereof;

a pair of circular recesses formed within each of said side frames at a lateral mid-point for insert of said axle member;

a plurality of locating holes formed through each of said side frames on opposing longitudinal ends of said side frames within said crib cavity;

said locating holes being formed along an arc such that the distance from each of said locating holes to a corresponding circular recess in said side frame is a constant;

said axle members extending transversely beyond the transverse extension of said side frames;

said floor members for mounting within said crib cavity to provide a crib bottom by placing said extended axle members into respective circular recesses formed within said side frames, said floor members positionally located at a predetermined inclination by inserting an extended bolt member of said floor members into pairs of said locating holes of said side frames for supporting upper and lower portions of a baby's body;

a pair of microphones mounted internal to said crib cavity, each of said microphones being mounted to a respective one of said side frames;

a pair of moisture sensors located within each of said floor members for sensing moisture content of said floor members;

means for vibrating said floor members responsive to an audio input to said pair of microphones; and, blower means for expelling air internal said crib cavity responsive to moisture sensing by said moisture sensors.

2. A baby crib as claimed in claim 1, including means for activating audio output device responsive to an audio input to said pair of microphones or moisture sensing by said moisture sensors.

* * * * *